United States Patent [19]

D'Anna

[11] 4,443,033

[45] Apr. 17, 1984

[54] DOOR SECURING APPARATUS AND METHODS OF CONSTRUCTING AND UTILIZING SAME

[76] Inventor: Michael A. D'Anna, 25255 Castlewood Dr., Woodhaven, Mich. 48183

[21] Appl. No.: 257,527

[22] Filed: Apr. 27, 1981

[51] Int. Cl.[3] ..... E05C 3/06

[52] U.S. Cl. ..... 292/235; 292/338; 292/DIG. 36

[58] Field of Search ..... 292/235, 238, 230, 225, 292/305, 338, 171, 141, 133, 50, DIG. 36

[56] References Cited

U.S. PATENT DOCUMENTS

| | | | |
|---|---|---|---|
| Re. 27,161 | 8/1971 | Raymon | 292/338 X |
| 166,259 | 8/1875 | Church | 292/171 |
| 766,331 | 8/1904 | Doherty | 292/133 |
| 979,017 | 12/1910 | McClaskey | 292/50 |
| 2,114,910 | 4/1938 | Shattuck | 292/305 |
| 2,714,033 | 7/1955 | Lewgowd | 292/305 |
| 2,857,192 | 10/1958 | Peterson | 292/225 X |
| 3,695,332 | 10/1972 | Bahnsen | 292/225 X |
| 3,838,877 | 10/1974 | Hanson | 292/DIG. 36 X |

*Primary Examiner*—Gary L. Smith
*Assistant Examiner*—R. Illich
*Attorney, Agent, or Firm*—Irving M. Weiner; Pamela S. Burt; John L. Shortley

[57] ABSTRACT

A door securing apparatus, particularly for securing a garage door, including a first member for securing to a structural member of the garage, a second member for selectively engaging a portion of the garage door, and a bar connected between the first and second members for bracing the second member against the garage door portion. A cable assembly is provided for conveniently selectively moving the apparatus between a locked position wherein the second member engages and is braced against the garage door portion and an unlocked position wherein the second member is spaced from the door to permit unobstructed opening and closing of same.

9 Claims, 5 Drawing Figures

DOOR SECURING APPARATUS AND METHODS OF CONSTRUCTING AND UTILIZING SAME

BACKGROUND OF THE INVENTION

1. Field of the Invention

The present invention relates generally to a door securing apparatus. More particularly, the invention relates to an apparatus for securing a sliding garage door in a locked position.

The terminology "garage door" and "sliding garage door" as employed herein is intended to connote an overhead swinging garage door of the type which is conventionally employed in residential structures or which may be employed in other applications such as in commercial structures, which may comprise a rigid door or a sectional door which is deformable during opening and closing thereof, and which is slidably opened and closed.

2. Description of Relevant Art

Due to the widespread use of garages for storing vehicles as well as other items of value such as lawn equipment, etc., there has developed a desideratum for a garage door securing apparatus which will effectively lock the door against entry by intruders. In view of the constructional details of conventional garage door structures, i.e., of either the aforesaid rigid type or sectional type, known garage door securing devices have generally met with quite limited success in attempting to fulfill the aforesaid desideratum.

Illustrative of known door locking devices is the "DOOR BRACE" disclosed in U.S. Pat. No. 1,631,980 issued in 1927 to Piccirilli. Such device is adapted for use with a conventional side-opening door, and includes a bracing rod having an upper end connected to the door by a flanged member connected to the upper end of the rod and received within a socket disposed in the door below the door knob, or alternatively the bracing rod is directly connected at its upper end to the door knob itself. The lower end of the bracing rod is provided with slip-resistant means for engaging the floor such that the bracing rod is braced in an angular position between the floor and the door. In its inoperative position, the bracing rod is swung sidewardly and latched against a lower portion of the door.

Another known door locking device is disclosed in U.S. Pat. No. 3,608,940 issued in 1971 to Mueller and entitled "SLIDABLE DOOR SAFETY LOCK". Such safety lock device is adapted for slidable glass panel doors, and includes a rod member having a hook at one end which engages with an eye of a keeper member affixed to a wall or frame of one of the doors. A swing bolt assembly is attached to the side frame of the other glass panel, and an extended end of the bolt engages in a telescoping manner within a tubular portion of the rod member. A latch member is provided on the bolt.

The present invention overcomes the shortcomings and disadvantages attendant the aforesaid known locking devices, and at the same time eminently fulfills the aforesaid desideratum by providing a securing apparatus which effectively prevents undesired entry through a garage door by an intruder. Further, the apparatus in accordance with the invention is constructed with a minimum number of parts and at a reduced cost of manufacture.

SUMMARY OF THE INVENTION

The present invention provides a door securing apparatus including first means for securing the apparatus to a structural member, second means for selectively engaging a portion of a door to be secured, third means connected between the first means and second means for bracing the second means against the portion of the door, and fourth means for selectively moving the second means between a locked position of the apparatus wherein the second means is engaged with and braced against the portion of the door to be secured and an unlocked position of the apparatus wherein the second means is substantially spaced from the portion of the door to be secured.

In accordance with a preferred embodiment of the invention, each of the first and second means comprises angle iron members, and the third means comprises a substantially rigid elongated bar member which is rigidly secured adjacent one end thereof to the second means and is hingedly secured adjacent the opposite end thereof to the first means. The first means (i.e., angle iron member) is fixedly secured to a ceiling member of the garage, and the second means (i.e., angle iron member) is adapted to selectively engage the upper portion of a sliding garage door. The fourth means comprises a cable assembly including an elongated cable having one end thereof secured adjacent the second means and the other end thereof provided with a stop member which operatively cooperates with a wall mounted member to define a stop arrangement whereby the apparatus may be selectively held in the unlocked position thereof.

It is an object of the present invention to provide a door securing apparatus particularly adapted for preventing entry by intruders through a conventional garage door, and which may be conveniently moved by a user of the apparatus between a locked position and an unlocked position.

A further object of the invention is to provide a garage door securing apparatus which may be readily adjusted to accommodate various different garage structures. To this end, the third means (i.e., elongated bar member) is adjustable in length.

The above and other objects and details of the present invention will become apparent from the following description, when read in conjunction with the accompanying drawings.

DETAILED DESCRIPTION OF PREFERRED EMBODIMENTS

Figure 1:
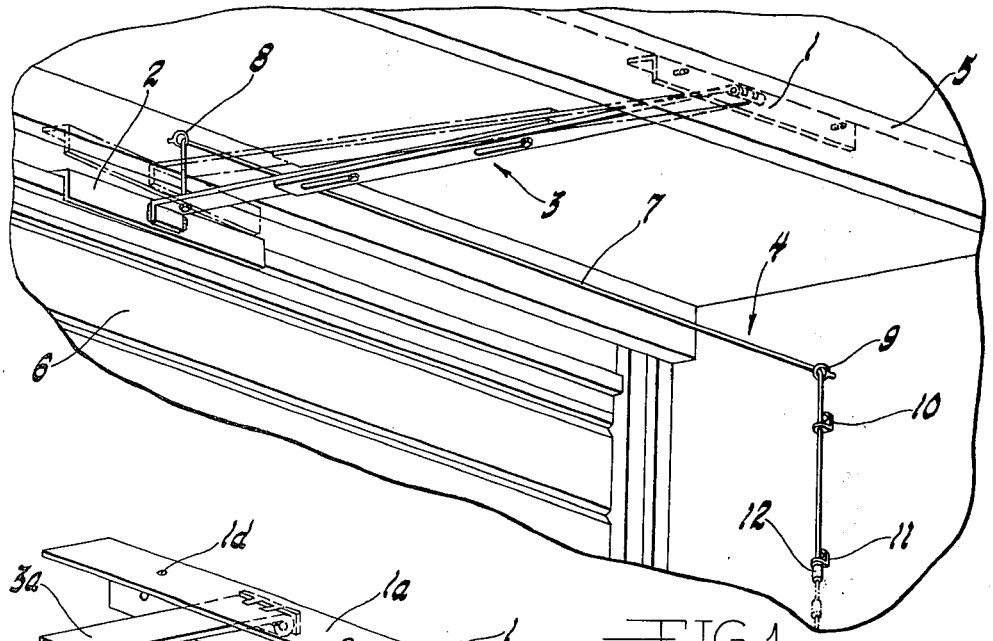
FIG. 1 is a perspective view of the securing apparatus in accordance with the invention, shown in an operatively mounted position within a garage.

With reference to FIG. 1, the apparatus in accordance with the present invention (the individual parts of which will be described in detail hereinbelow with reference to FIGS. 2–5) is shown in its entirety in a mounted position within a garage. The apparatus includes first means for securing to a structural member, in the form of an angle iron member 1 which is shown as fixedly secured to a ceiling beam or stud member 5 of the garage. Second means for selectively engaging an upper portion of the garage door 6 is also provided in the form of an angle iron member 2. Third means connected between the angle iron members 1 and 2 for bracing the angle iron member 2 against the upper portion of garage door 6 comprises a substantially rigid elongated member, such as steel bar member 3. Steel bar 3 is hingedly affixed at the rear end thereof to angle iron member 1 and is fixedly secured at the forward end thereof to angle iron member 2, as will be described in greater detail hereinbelow. Fourth means for selectively moving the apparatus between locked and unlocked positions thereof is provided in the form of a cable assembly 4, which will also be described in greater detail hereinbelow.

Figure 4:
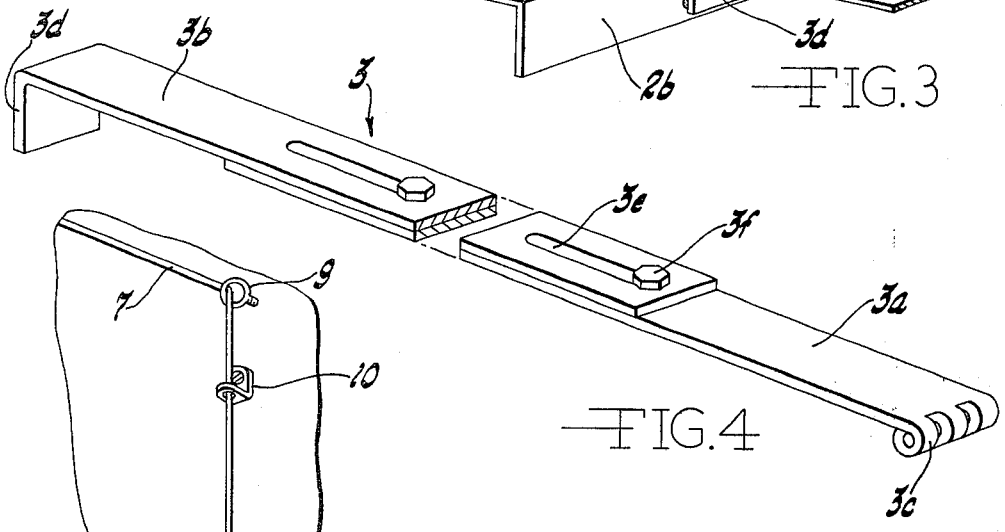
FIG. 4 depicts a perspective view of the adjustable elongated bar bracing member in accordance with the invention.

As shown in FIG. 4, steel bar 3 is preferably formed of two steel bar sections 3*a* and 3*b* which are overlapped and fastened together along the longitudinal dimensions thereof by means of a fastening arrangement including longitudinal slots 3*e* through which bolts 3*f* are received. It will be understood that the length dimension of steel bar 3 may thus be readily adjusted by loosening bolts 3*f*, relatively sliding bar sections 3*a* and 3*b* to provide the desired length dimension, and then tightening bolts 3*f*. By way of example, the overall length dimension of steel bar 3 may be approximately two feet, five feet, eight feet, or other lengths, with length adjustment of several inches or longer being provided by the aforesaid fastening arrangement. The steel bar 3 is thus adaptable in length to accommodate varying garage mounting arrangements.

Figure 2:
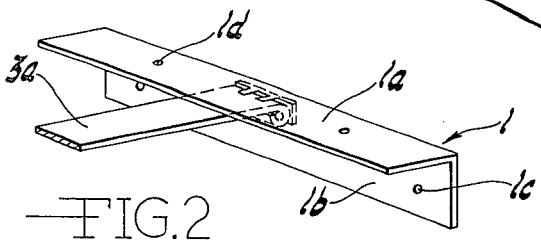
FIG. 2 depicts a perspective view of a first angle iron member hingedly connected with one end of an elongated bar bracing member in accordance with the invention.
Figure 3:
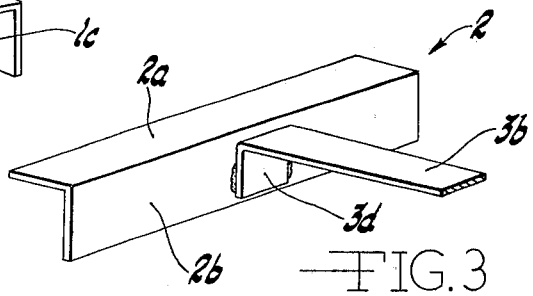
FIG. 3 illustrates a perspective view of a second angle iron member fixedly connected with the other end of the elongated bar bracing member according to the invention.

The steel bar section 3*a* includes an integral hinge connection portion 3*c* at the rear end thereof which cooperates with a mating hinge connection portion integrally provided (such as by welding) on angle iron member 1 (FIG. 2). The other steel bar section 3*b* includes an integral bent portion 3*d* at the forward end thereof for fixedly securing (such as by welding) to angle iron member 2 (FIG. 3). The steel bar 3 is preferably formed of a rigid substantially high-strength metal, such as steel, to provide sufficient strength for the bracing function it is to perform, as will be described hereinbelow.

With reference to FIG. 2, the first angle iron member 1 is shown in greater detail as including a portion 1*a* which extends at right angles to a portion 1*b*. The hinge connection with steel bar section 3*a* is disposed on the inner surface of portion 1*b*, while the outer surface of portion 1*b* is mounted in abutting engagement with ceiling beam 5 as shown in FIG. 1 by means of suitable threaded fasteners received through a pair of spaced mounting holes 1*c* provided in portion 1*b*. The outer surface of portion 1*a* of angle iron member 1 is secured, for example, to the garage ceiling itself (FIG. 1) by means of suitable threaded fasteners received through a pair of spaced mounting holes 1*d* provided in portion 1*a*. In this manner, the angle iron member 1 is rigidly and fixedly secured to the garage ceiling and beam, while steel bar 3 is permitted to hingedly move relative thereto. It will be understood that the angle iron member 1 may be replaced by a mounting and securing means of another configuration if desired, to permit modification of the apparatus for mounting in another type of application.

As shown in FIG. 3, the second angle iron member 2 includes a portion 2*a* which extends at right angles to a portion 2*b*. The bent portion 3*d* of steel bar section 3*b* is integrally connected with the outer surface of portion 2*b*, such as by welding. In operation, the inner surfaces of portions 2*a* and 2*b* of angle iron member 2 will mate with and engage the top edge surface and the inner-side edge surface of the upper right-angled edge portion of garage door 6, (which may comprise a frame member of the door), as shown in FIG. 1. To this end, it will be understood that length adjustment of steel bar 3 is effected such that when the apparatus is mounted as shown in FIG. 1 the angle iron member 2 will be oriented adjacent the upper edge of garage door 6. Further, it will be understood that the second means for engaging the door portion is not limited to the particular configuration of angle iron member 2, and members of other shapes and sizes may alternatively be employed so as to adapt the apparatus to various types of door constructions.

The cable assembly 4 for selectively moving the apparatus between locked and unlocked positions thereof will now be described with reference to FIGS. 1 and 5. As shown in FIG. 1, an elongated cable member 7 (which may comprise a steel cable of approximately 20 feet, for example) is affixed at one end thereof to the forward end of steel bar 3 adjacent angle iron member 2. The cable 7 is led through an upper eyebolt 8 which is threadedly fastened to an upper garage frame member. The cable 7 is then extended substantially horizontally and is passed through a second eyebolt 9 which is wall-mounted. A loop guide 10 is mounted to the garage wall below eyebolt 9, and cable 7 is led through guide 10 and through a wall-mounted slitted member 11, which may be formed of plastic for example. In installing the apparatus, cable 7 is led through the various members as described, and may then be cut such that a short length thereof extends below slitted member 11. Attached to this end of cable 7 is a stop member 12 which cooperates with slitted member 11 to define a stop arrangement. The orientation of such stop arrangement is such that it is readily and conveniently accessible to a user of the apparatus, and to this end the stop arrangement is preferably located at a convenient wall location which may be easily reached by the user.

The operation of the securing apparatus in accordance with the invention will now be described with reference to FIG. 1, wherein the solid line illustration of steel bar 3 and angle iron member 2 represents the locked position of the apparatus and the broken-line illustration thereof represents the unlocked position.

Figure 5:
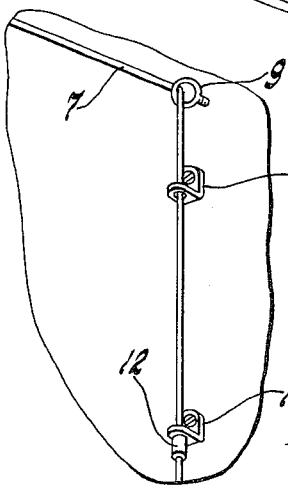
FIG. 5 illustrates a perspective view of a portion of the cable assembly for moving the apparatus between locked and unlocked positions in accordance with the invention.

With the cable assembly in the position shown in FIGS. 1 and 5, the forward end of the apparatus (i.e., second angle iron member 2) is held in a raised position such that angle iron member 2 is disposed above and spaced from the upper edge of garage door 6. In this position, stop member 12 is held by slitted member 11 such that cable 7 is tensioned to hold the apparatus in its raised unlocked position. In this regard, it will be understood that stop member 12 is suitably positioned during installation at the proper point along cable 7 such that cable 7 is tensioned when stop member 12 is engaged against slitted member 11.

In the aforesaid unlocked position of the apparatus, steel bar 3 is substantially upwardly inclined and angle iron member 2 is raised above the upper edge of the garage door 6 to afford sufficient clearance so as to permit unobstructed opening and closing of garage door 6.

When it is desired to move the apparatus to its locked position, the user employs stop member 12 as a handle and slides cable 7 out of member 11 through the slit provided therein (not specifically shown but extending leftwardly in FIG. 5). Cable 7 is then permitted to slide upwardly through guide 10 and eyebolt 9 so as to thus lower the forward end of the apparatus (by its own weight) until the angle iron member 2 engages the uppermost horizontal portion of the garage door 6 (which portion may comprise a frame member of the door). In this position, steel bar 3 will be substantially horizontally disposed.

It will thus be understood that the apparatus is easily and conveniently moved by the user between the locked and unlocked positions thereof via cable assembly 7. With the apparatus disposed in the lowered locked position thereof, the garage door 6 is effectively secured against entry from outside by intruders, with second angle iron 2 being braced against the upper door portion by means of steel bar 3 which is attached in turn to fixedly-mounted angle iron member 1. With such arrangement, tampering with the apparatus from outside is impossible, and thus the garage and its contents will be effectively protected from vandalism. If the garage is of the attached type which is attached to a residential dwelling, the security of the dwelling itself will also thus be substantially enhanced.

The present invention is not limited in its application to garage doors, and it is contemplated that the security apparatus may be readily adapted for use with other types of doors or closures.

Although there have been described what are at present considered to be the preferred embodiments of the invention, it will be understood that the present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

I claim:

1. A door securing apparatus for an overhead swinging door, comprising:

first means for securing said apparatus to a structural member which is spaced apart a substantial distance in a horizontal direction from a door to be secured, said first means being mounted on said structural member so as to be spaced inwardly from an inner surface of said door at said substantial distance from said door;

second means for selectively engaging an upper portion of said door to be secured, said second means comprising a substantially elongated rigid member having a substantially L-shaped cross section which defines two inner surface portions extending at substantially right angles to each other;

a first one of said inner surface portions of said second means being selectively engageable with a top edge surface of said upper door portion while the second one of said inner surface portions is engageable with an inner-side edge surface of said upper door portion;

third means connected between said first means and said second means for bracing said second means against said upper portion of said door;

said third means comprising a substantially rigid elongated bar member having a length dimension sufficient to span said substantial distance between said structural member and said door, said bar member being rigidly secured adjacent one end thereof to said second means and being hingedly secured adjacent the opposite end thereof to said first means; and fourth means for selectively moving said second means between a locked position of said apparatus wherein said second means is engaged with and braced against said upper portion of said door to be secured, and an unlocked position of said apparatus wherein said second means is substantially spaced from said upper portion of said door to be secured.

2. A door securing apparatus according to claim 1, wherein:

said first means comprises a substantially rigid member including at least one substantially flat mounting surface for mounting against said structural member;

said structural member comprises a ceiling member; and said flat mounting surface of said substantially rigid member is fixedly secured to said ceiling member.

3. A door securing apparatus according to claim 2, wherein:

said substantially rigid elongated bar member is adjustable in length; and said substantially rigid elongated bar member is disposed in a substantially horizontal position in said locked position of said apparatus.

4. A door securing apparatus according to claim 1 or 3, wherein: said fourth means comprises a cable assembly including:

an elongated cable having one end thereof secured adjacent said second means;

at least one cable positioning member secured to an interior wall surface, said cable being substantially loosely passed through said positioning member;

a stop arrangement including a wall mounted member which operatively cooperates with a stop member disposed on said cable adjacent the other end thereof to selectively hold said apparatus in said unlocked position thereof; and said other end of said cable being disposed in an operative position to permit a user of said apparatus to move said apparatus between said locked and said unlocked positions via said cable assembly.

5. A door securing apparatus according to claim 2, wherein:

both said first means and said second means comprise angle iron members.

6. A door securing apparatus according to claim 5, wherein:

said substantially rigid elongated bar member comprises two substantially elongated bar portions connected together by a fastening arrangement which permits length adjustment of said elongated bar member.

7. A door securing apparatus according to claim 3, wherein:

said elongated bar member is disposed in a substantially upwardly inclined position with said second means secured thereto disposed substantially above and spaced from said upper portion of said door when said apparatus is disposed in said unlocked position thereof, so as to permit unobstructed opening of said door in said unlocked position of said apparatus.

8. A door securing apparatus according to claim 1, wherein:

said one end of said elongated bar member of said third means is rigidly secured to said rigid member of said second means at an outer surface portion thereof opposite said second one of said inner surface portions.

9. A door securing apparatus according to claim 1, wherein:

said apparatus is entirely free of any operable engagement with or connection to said door when said apparatus is in said unlocked position.

* * * * *